US009834894B1

(12) United States Patent
Reed et al.

(10) Patent No.: US 9,834,894 B1
(45) Date of Patent: Dec. 5, 2017

(54) DRAIN CHANNEL

(71) Applicants: Daniel E. Reed, Strafford, MO (US); Amanda Reed, Springfield, MO (US)

(72) Inventors: Daniel E. Reed, Strafford, MO (US); Amanda Reed, Springfield, MO (US)

( * ) Notice: Subject to any disclaimer, the term of this patent is extended or adjusted under 35 U.S.C. 154(b) by 0 days.

(21) Appl. No.: 15/016,938

(22) Filed: Feb. 5, 2016

Related U.S. Application Data

(60) Provisional application No. 62/112,385, filed on Feb. 5, 2015.

(51) Int. Cl.
*E03F 5/04* (2006.01)
*E01C 11/22* (2006.01)

(52) U.S. Cl.
CPC ..... *E01C 11/227* (2013.01); *E03F 5/0407* (2013.01); *E01C 2201/207* (2013.01)

(58) Field of Classification Search
CPC ..... E03F 5/04; E03F 5/0401; E03F 5/0407; E03F 5/06; E03F 2005/0412
USPC ..... 210/163, 164; 405/118
See application file for complete search history.

(56) References Cited

U.S. PATENT DOCUMENTS 139,324 A 5/1873 McClunie ..... 404/2
2,701,027 A * 2/1955 Scoville ..... E01C 11/227 210/163
3,089,396 A * 5/1963 Rowland ..... E03F 5/06 210/163
3,127,821 A * 4/1964 Lebaron, Jr. ..... E03F 5/06 210/163
3,446,025 A 5/1969 Koch ..... 405/43
4,126,404 A * 11/1978 Ferns ..... E03F 5/06 210/163
4,367,142 A * 1/1983 Blecher ..... E03F 5/06 210/163
4,498,807 A 2/1985 Kirkpatrick et al. ..... 405/43
4,787,773 A * 11/1988 Kehler ..... E03F 3/046 404/4
4,878,782 A 11/1989 Beattie et al. ..... 405/119
4,952,094 A * 8/1990 Spiess ..... E02D 29/1427 210/165
5,226,748 A 7/1993 Barenwald et al. ..... 405/121
(Continued)

FOREIGN PATENT DOCUMENTS

CH 374944 A * 1/1964 ..... E03F 5/06
DE 19622021 A1 * 12/1997 ..... E03F 5/06
(Continued)

*Primary Examiner* — Frederick L Lagman
(74) *Attorney, Agent, or Firm* — Jonathan A. Bay

(57) ABSTRACT

A drainage installation (20), for a warehouse and/or factory floor that has a surface level (26), has a drainage channel (24) recessed into the floor and a plurality of sections of flat grating (22) seated inside the drainage channel (24). The drainage channel (24) has an axially-elongated, square-U shaped channel portion which is flanked by horizontal shoulders (30), which then transition into vertically-depending skirt portions (32). The horizontal shoulders (30) as well as the sections of flat grating (22) are arranged to be more less planar with the surface level (26). Wherein, the skirt portions (32) are formed with a series of apertures (36) which either allow the injection of wet cement underneath the shoulder portions (30) of the drainage channel (24), or alternately the venting of the wet cement when the cavity under the shoulder portions (30) are over-filled.

10 Claims, 12 Drawing Sheets

(56) References Cited

U.S. PATENT DOCUMENTS

| | | | | | |
|---|---|---|---|---|---|
| 5,372,457 | A | | 12/1994 | Rante | 405/119 |
| 5,478,169 | A | | 12/1995 | Stegall | 405/119 |
| 5,501,547 | A | * | 3/1996 | Mantelli | E01C 11/227 404/3 |
| 5,529,436 | A | | 6/1996 | Meyers | 405/119 |
| 5,718,537 | A | * | 2/1998 | Becker | E03F 3/046 404/2 |
| 5,735,637 | A | | 4/1998 | Gunter | 405/118 |
| 6,027,283 | A | * | 2/2000 | Schweinberg | E01C 11/227 404/4 |
| 6,113,311 | A | | 9/2000 | Becker et al. | 405/119 |
| 7,703,502 | B2 | | 4/2010 | Wallace et al. | 164/113 |
| 8,475,079 | B2 | * | 7/2013 | Humphries | E03F 3/046 249/11 |
| 2004/0136785 | A1 | * | 7/2004 | Gunter | E03F 3/046 405/118 |
| 2005/0025572 | A1 | * | 2/2005 | Sanfilippo | E03F 3/046 405/36 |
| 2008/0235885 | A1 | * | 10/2008 | Huang | E01C 9/10 14/69.5 |
| 2011/0203979 | A1 | * | 8/2011 | Schlueter | E03F 5/04 210/164 |

FOREIGN PATENT DOCUMENTS

| | | | | | |
|---|---|---|---|---|---|
| EP | 0811732 | A1 | * | 12/1997 | E03F 5/06 |
| WO | WO 2005035889 | A1 | * | 4/2005 | E03F 5/06 |
| WO | WO 2010088867 | A2 | * | 8/2010 | E03F 5/06 |

* cited by examiner

DRAIN CHANNEL

CROSS-REFERENCE TO PROVISIONAL APPLICATION(S)

This application claims the benefit of U.S. Provisional Application No. 62/112,385, filed Feb. 5, 2015. The foregoing patent disclosure is incorporated herein by this reference thereto.

BACKGROUND AND SUMMARY OF THE INVENTION

The invention relates to drainage installations and, more particularly, to drainage channels with flat grating at the surface level (e.g., warehouse and/or factory floor level).

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

FIG. 5*a* represents the excavation of an oversize trench;

FIG. 5*b* shows a shallow backfill of aggregate or concrete and the like;

FIG. 5*c* depicts the placement of pylon-serving, threaded rod;

FIG. 5*d* shows feet of drainage channel being landed on the threaded rod, and FIG. 5*e* shows completion of the assembly corresponding to FIG. 5;

DETAILED DESCRIPTION OF THE PREFERRED EMBODIMENTS

FIGS. 1-4 show a drainage installation 20 in accordance with the invention, which has sections of flat grating 22 seated inside drainage channel 24, and which sections of flat grating 22 are arranged to be more less planar with the surface level 26 of, for example and without limitation, a warehouse and/or factory floor.

Figure 1:
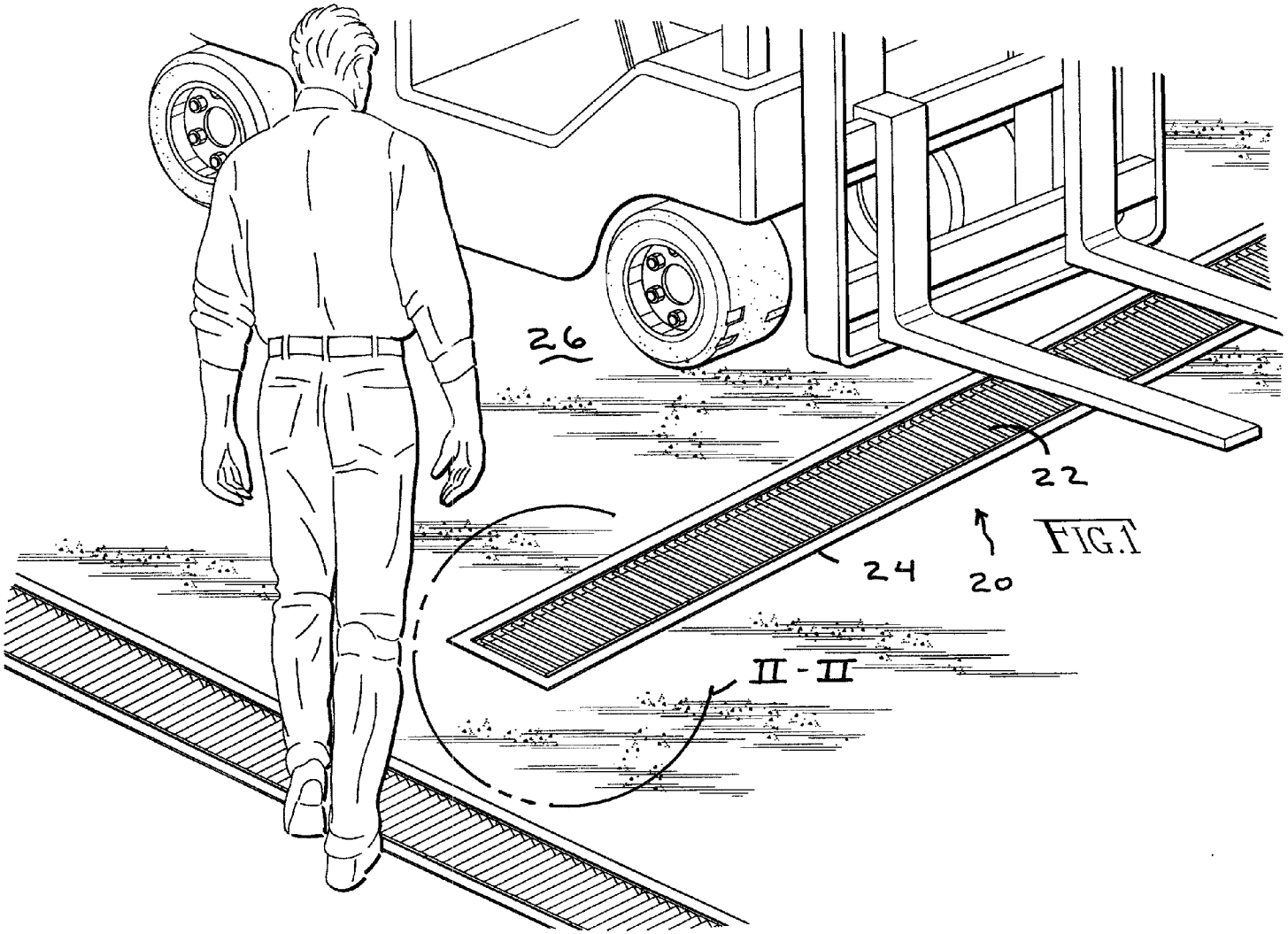
FIG. 1 is a perspective view of a drainage installation in accordance with the invention, which has flat grating at the surface level (e.g., warehouse and/or factory floor level)
Figure 2:
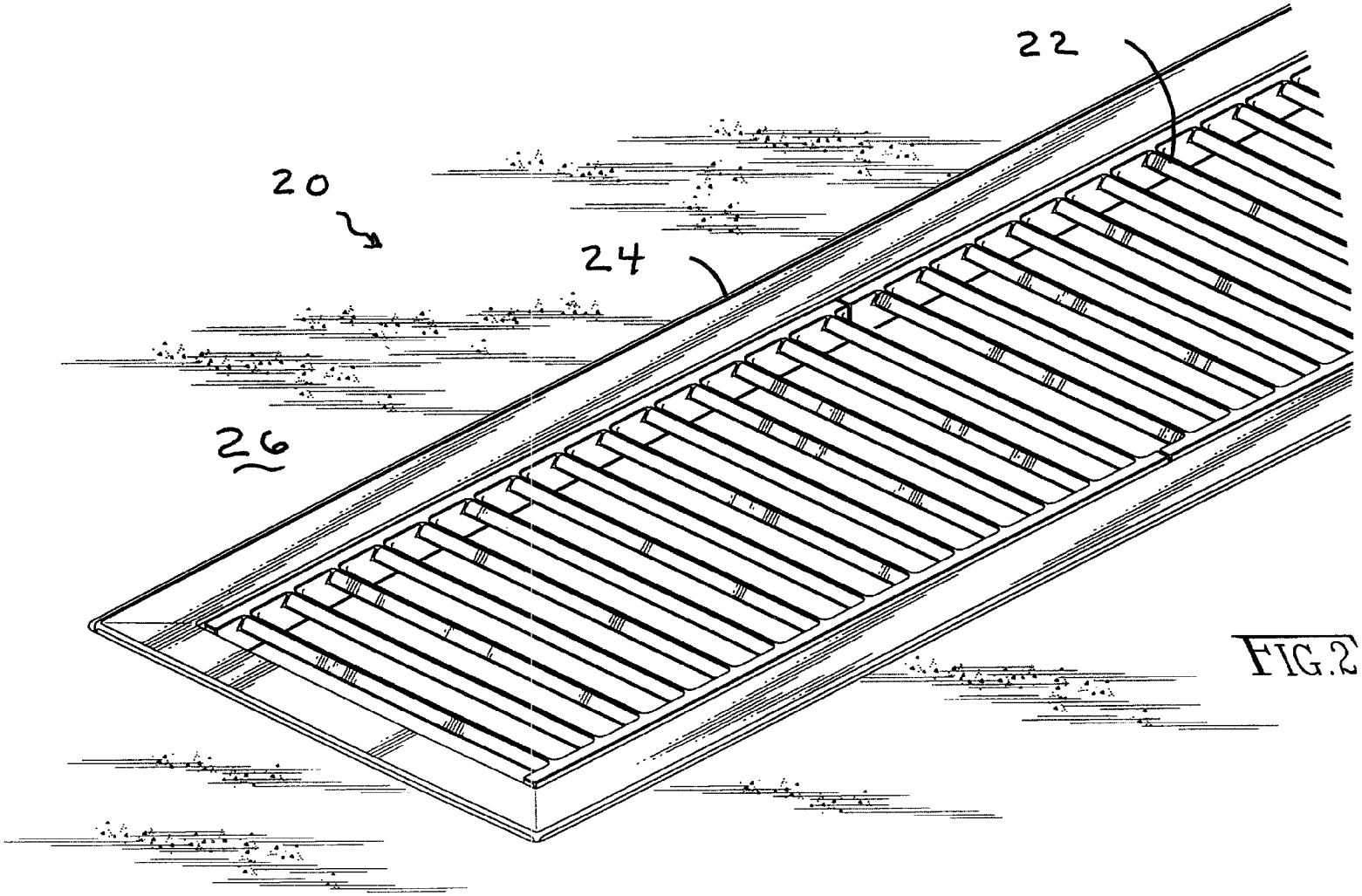
FIG. 2 is an enlarged scale perspective view of detail II-II in FIG. 1.
Figure 3:
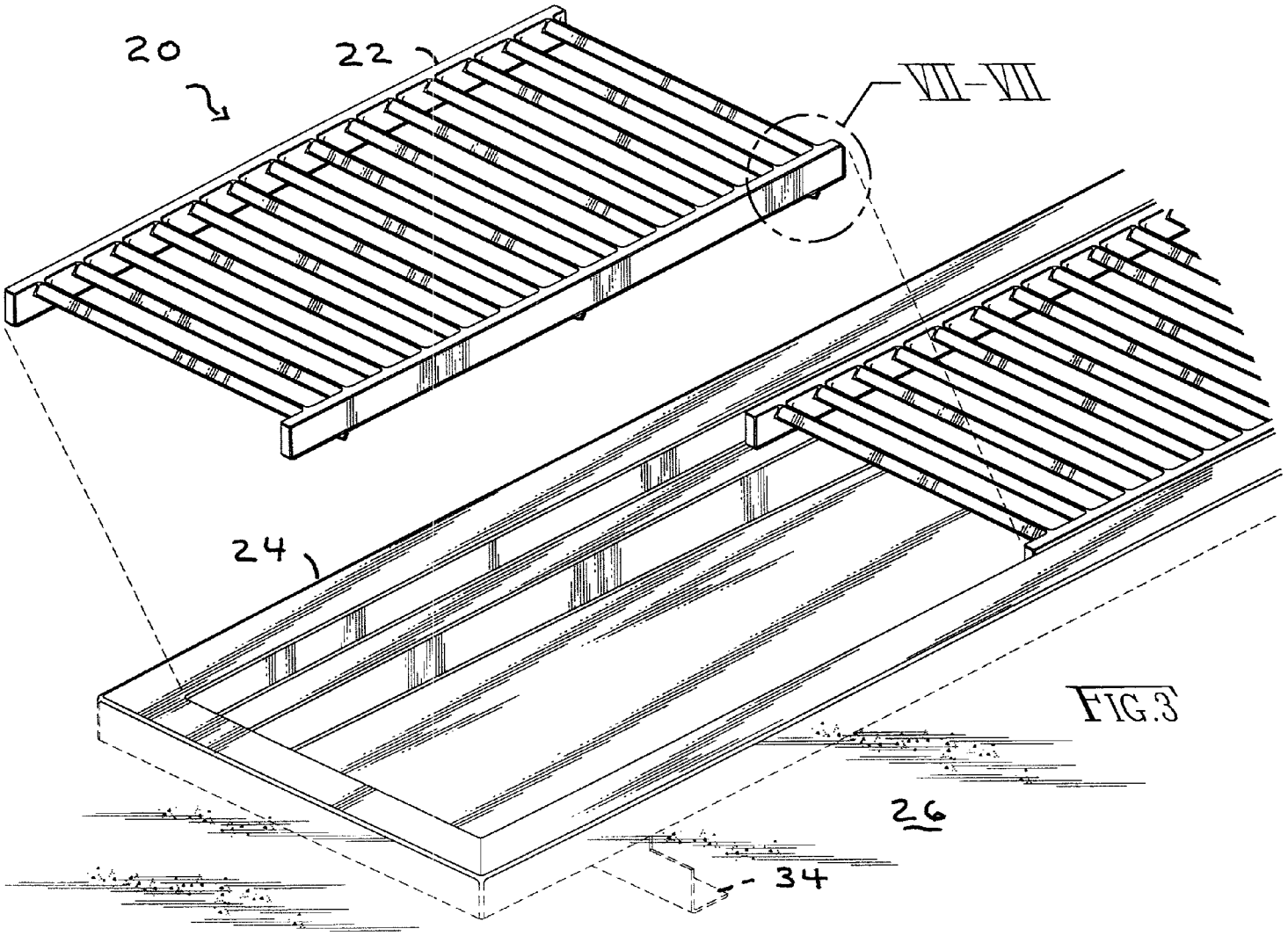
FIG. 3 is a perspective view comparable to FIG. 2 except with one section of the grating elevated out of and above the floor level drainage channel.
Figure 4:
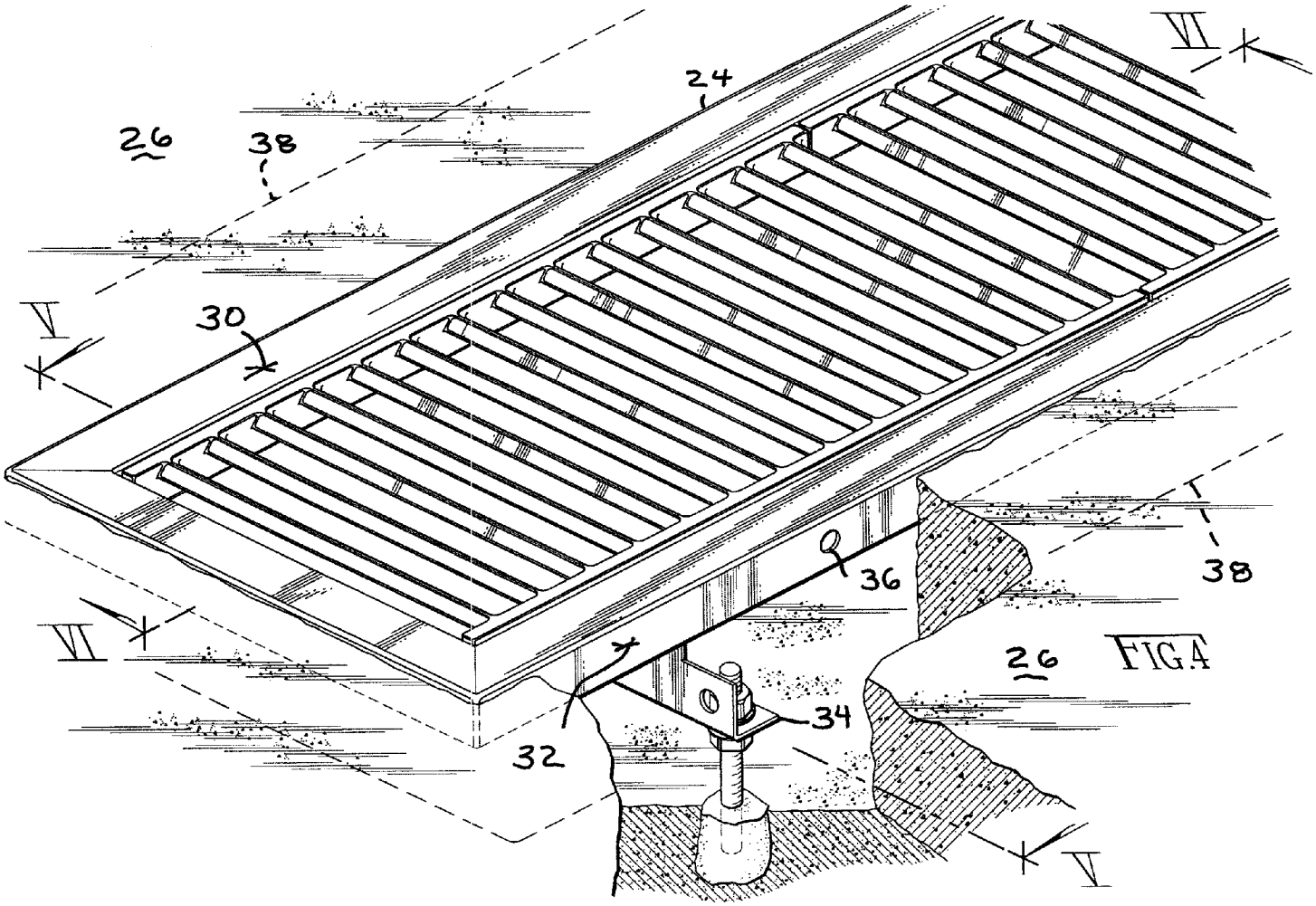
FIG. 4 is a perspective view likewise comparable to FIG. 2 except with portions of the surrounding floor matrix removed from view to show sub-floor level installation details of the drainage installation in accordance with the invention, in what would originally have been an open trench.

To turn to FIG. 4, the drainage channel 24 has an axially-elongated, square-U shaped channel portion which is flanked by horizontal shoulders 30 which then transition into vertically-depending skirt portions 32. The drainage channel 24 has inverted square-T shaped feet 34 at spaced intervals along the axial length (only one shown in FIG. 4). The skirt portions 32 are formed with a series of apertures 36 which either allow the injection of wet cement underneath the shoulder portions 30 of the drainage channel 24, or alternately the venting of the wet cement when the cavity under the shoulder portions 30 are over-filled. The drainage channel 24 could have been installed in a pre-existing concrete floor 26 which had no drainage (or which drainage needed replacement). Hence this drainage channel 24 would have originally been set in an open trench, for which reference numeral 38 indicates the outline thereof.

Figure 5:
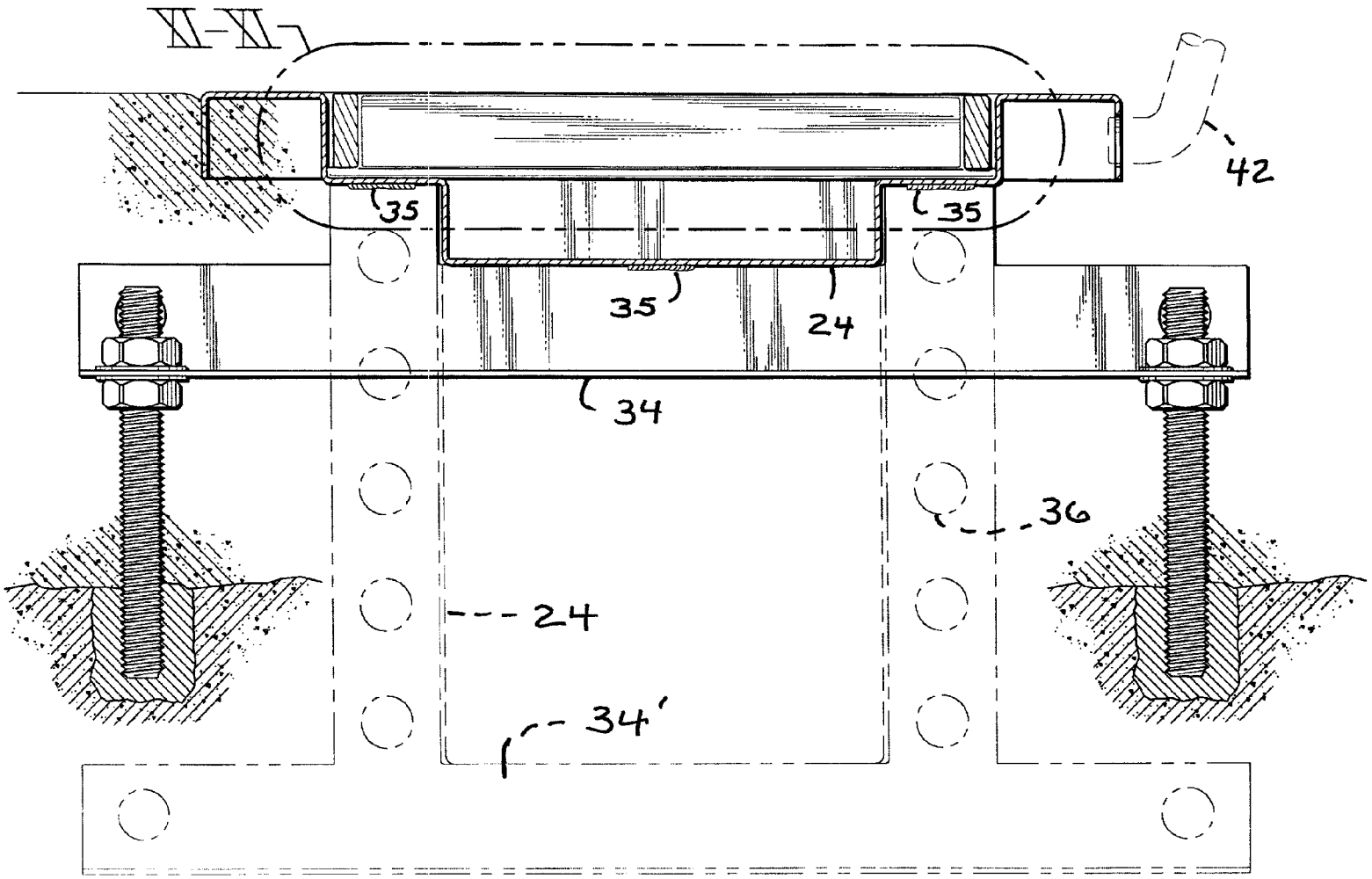
FIG. 5 is an enlarged scale elevational view, partly in section, taken in the direction of arrows V-V in FIG. 4.

FIG. 5 shows, among other things, a nozzle 42 for injecting wet cement in through any of the apertures 36 of skirt portions 32 (see FIG. 4). There is one short foot 34 in the foreground, and one tall foot 34' in the background and shown in dashed lines as drainage channel 24 progressively deepens in the distance.

FIG. 5 better shows that feet 34 are precision cut (laser cut in the example of 304 or 316 stainless plate stock) to firmly cradle the channel 24, and joined by weldments 35 as shown.

FIGS. 5*a* through 5*e* are a series of reduced scale section views taken along line V-V in FIG. 4 to show a non-limiting example of how to install the drainage installation 20 of FIGS. 1-4.

Figure 5A:
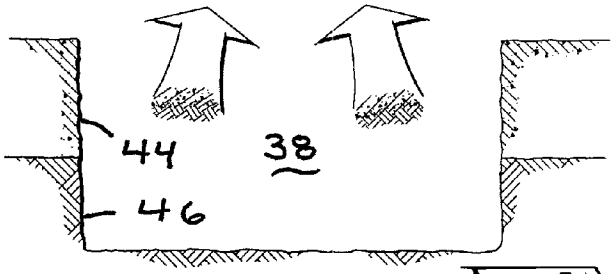
FIGS. 5*a* through 5*e* are a series of reduced scale section views taken along line V-V in FIG. 4 to show a non-limiting example of how to install the drainage installation of FIG. 4 in a pre-existing concrete floor, wherein:—

FIG. 5*a* represents the excavation of an oversize trench 38 through pre-existing concrete floor 44 and sub-layer 46 of aggregate, concrete, packed clay or the like.

Figure 5B:
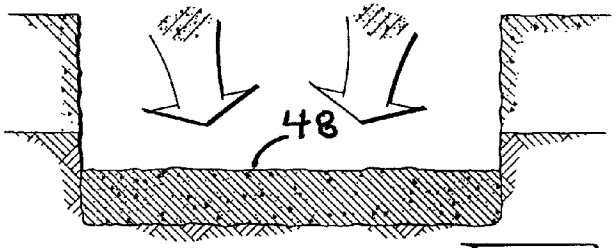

FIG. 5*b* shows a shallow backfill 48 of aggregate, concrete, packed clay, mortar and so on, without limitation.

Figure 5C:
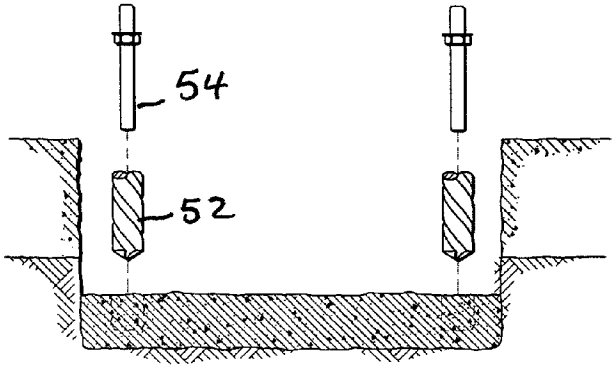

FIG. 5*c* depicts stylized drill bits 52 for drilling anchor holes for epoxying, bonding or otherwise anchoring pylon-serving, threaded rod 54.

Figure 5D:
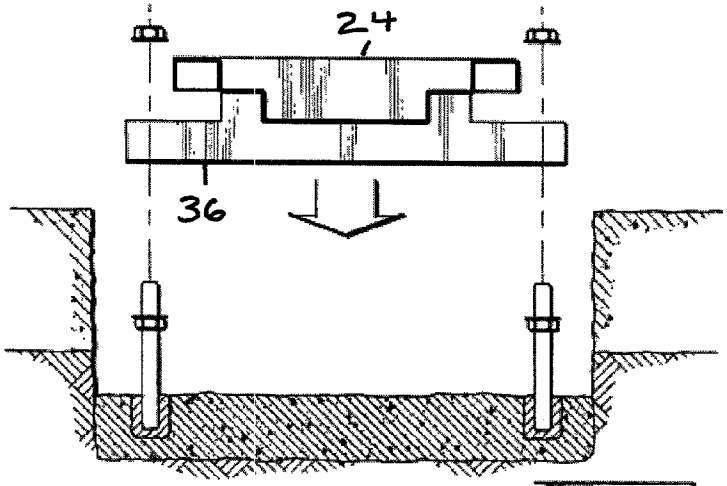

FIG. 5*d* shows the feet 34 of the drainage channel 24 being landed on the threaded rod 54.

Figure 5E:
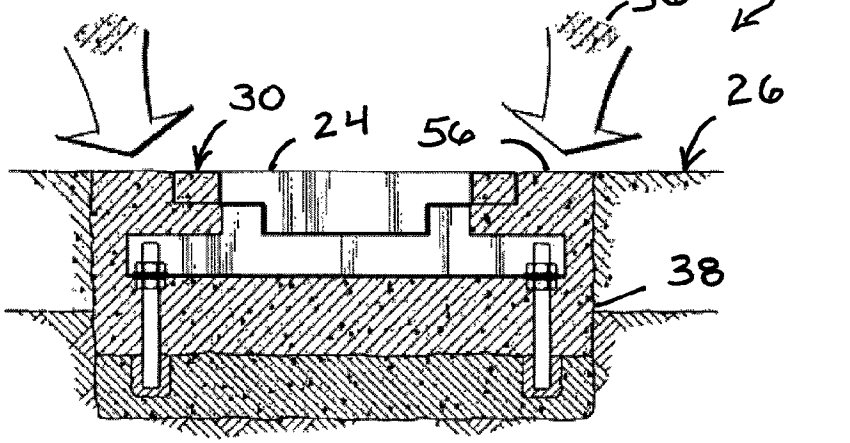

FIG. 5*e* shows completion of the installation assembly corresponding to FIG. 5, with the shoulders 30 of the drainage channel 24 level with the infill 56 of fresh concrete to fill in the trench 38 and even everything up level with the original pre-existing floor 36.

Figure 6:
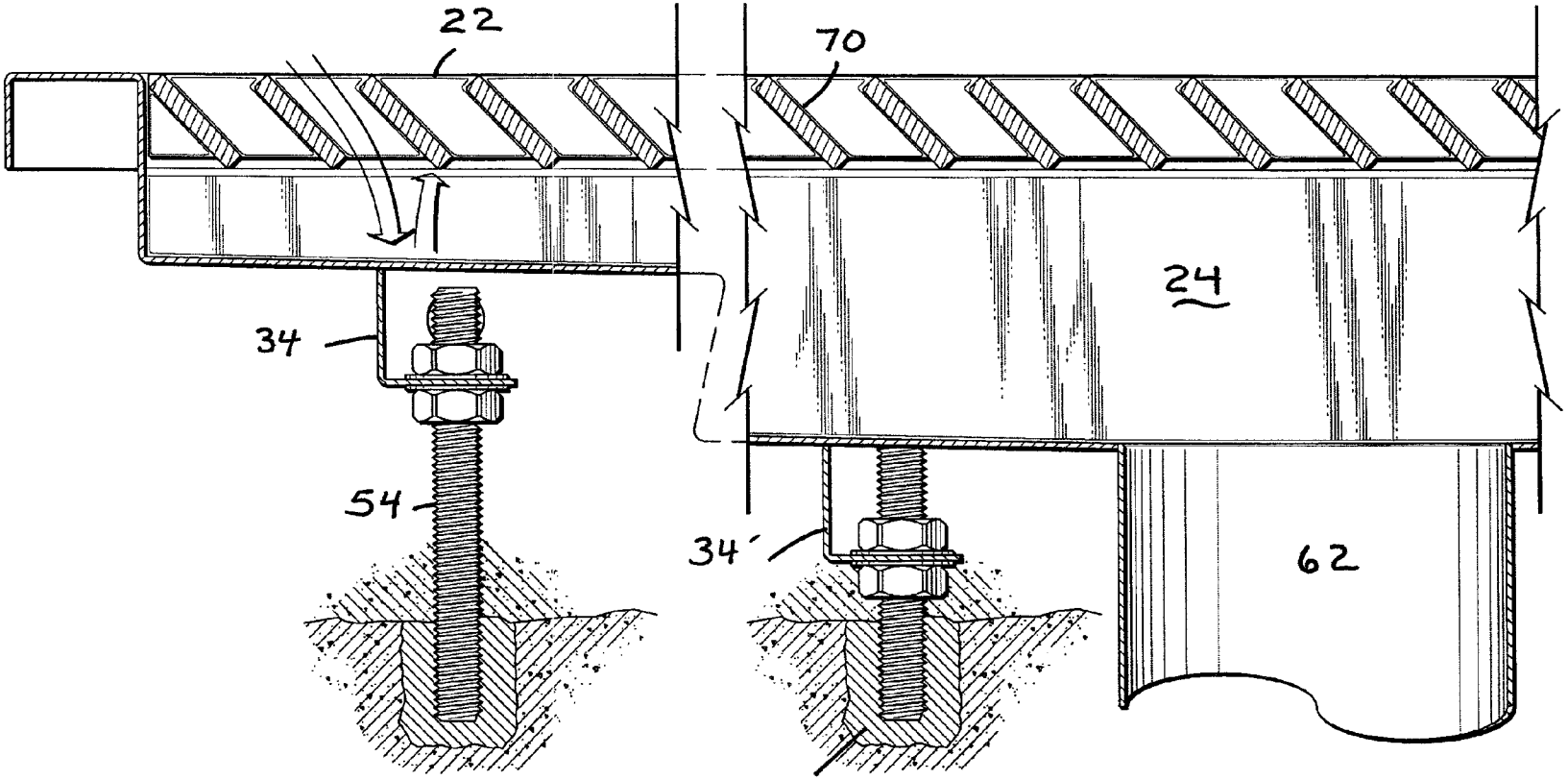
FIG. 6 is an enlarged scale elevational view, partly in section, taken in the direction of arrows VI-VI in FIG. 4, with middle portions broken away.

FIG. 6 shows, among other things, that the slope of the floor of the drainage channel 24 is sloped to lead to a drain downpipe 62 that empties into a buried drain line (not shown). The feet 34 and 34' are adjusted at respective elevations on their respective pylon-serving, threaded rods 54, which are sunk in epoxy footings 64.

Preferably the grating sections 22 are monolithic structures produced by investment casting a food-grade castable material, such as and without limitation 304 or 306 stainless. The drainage channel 24 would preferably be produced of the same material.

The grating sections 22 are formed with a series of spaced slats 70 emerging out of axial side rails 71. The slats 70 are slanted, and preferably are slanted such high pressure jets of water during periodic washdown operation do not bounce back out the drainage channel 24, but are deflected in the direction of the drain downpipe 62.

Figure 7:
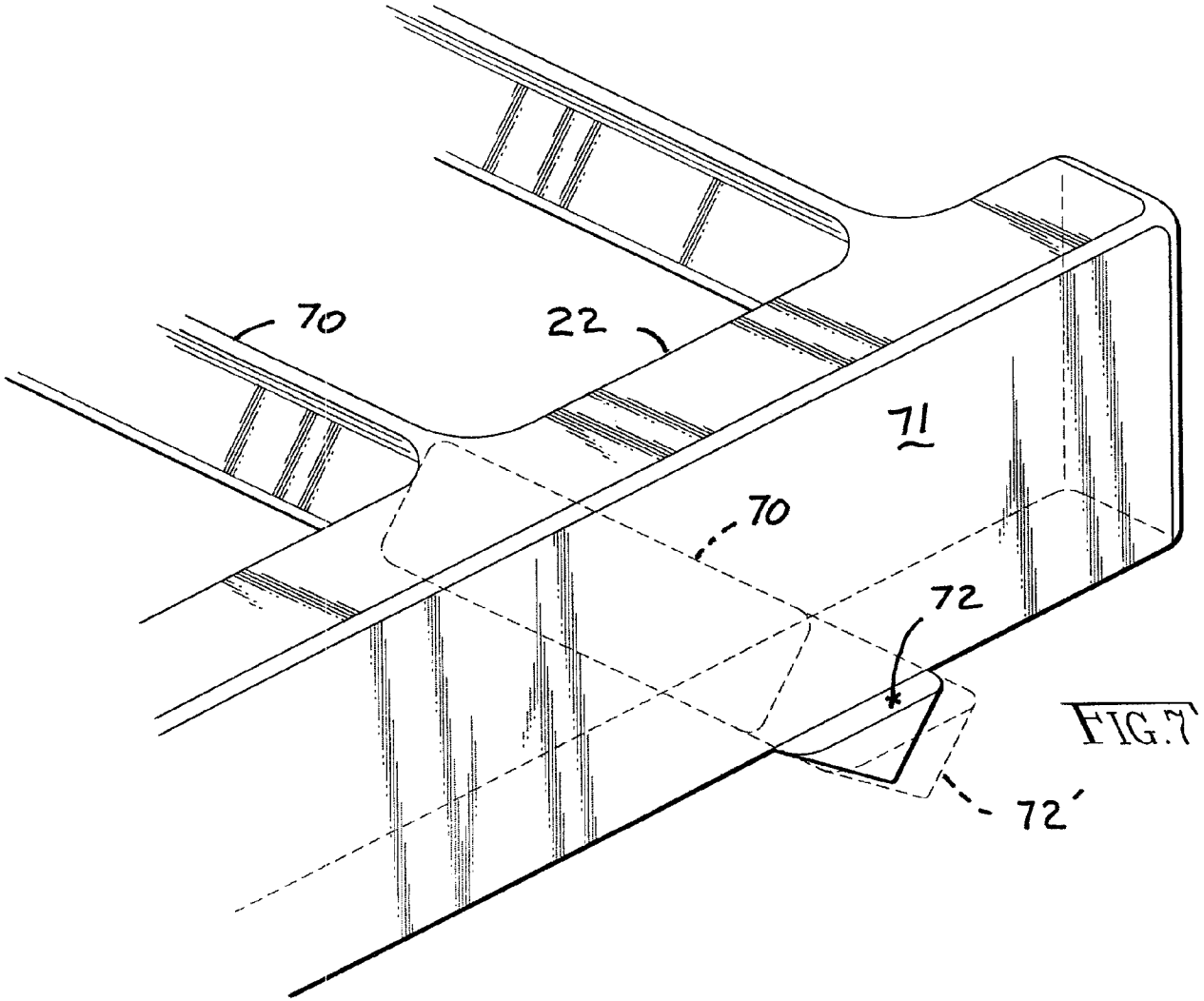
FIG. 7 is an enlarged scale perspective view of detail VII-VII in FIG. 3.
Figure 8:
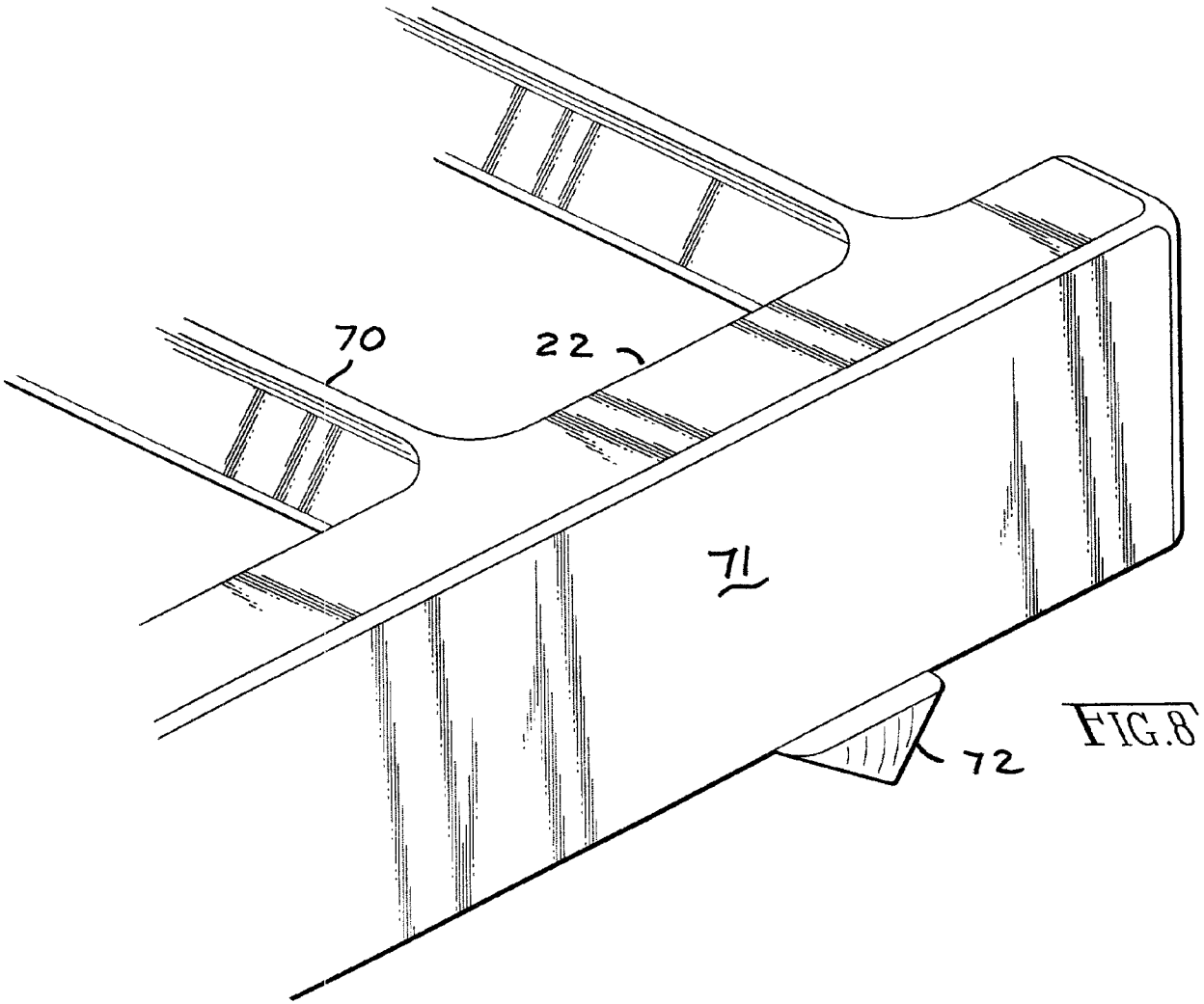
FIG. 8 is a perspective view comparable to FIG. 7 except the hidden lines removed for clarity.
Figure 9:
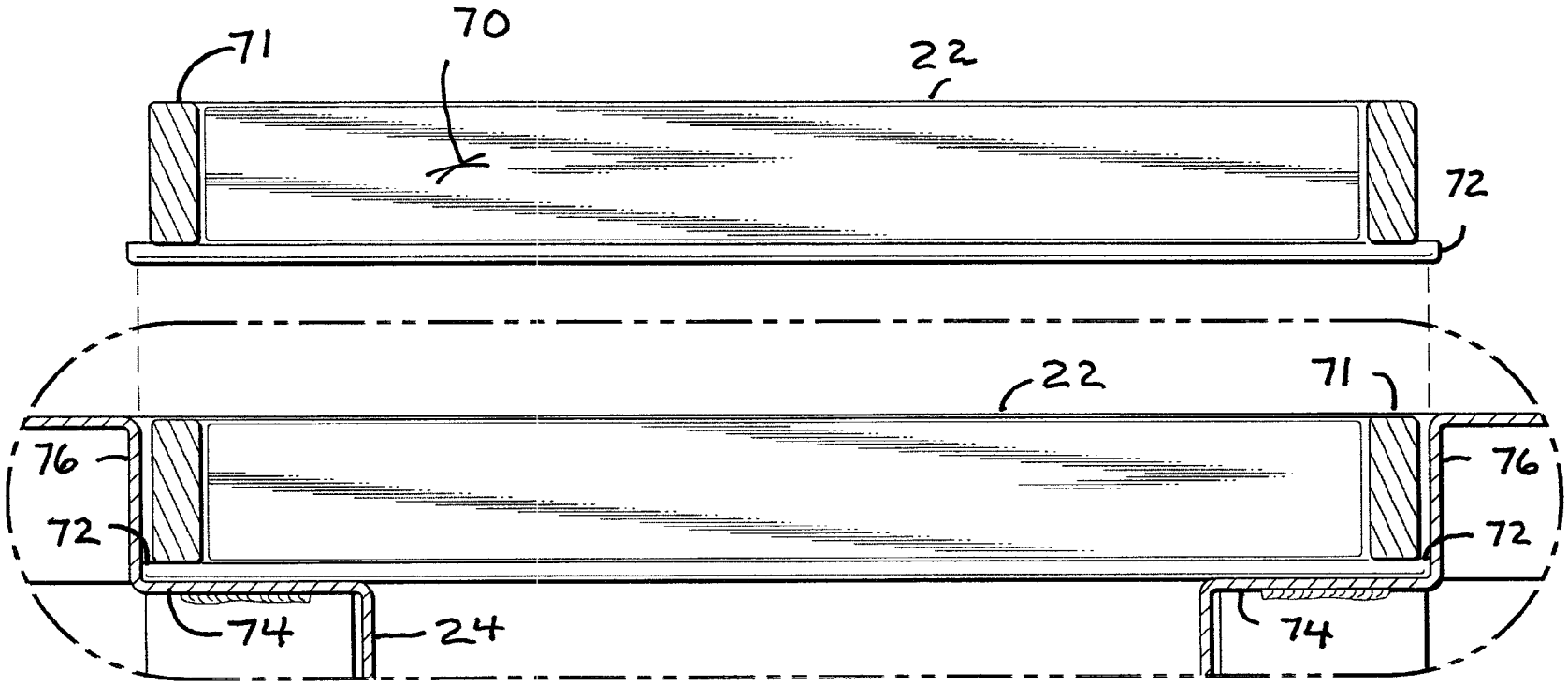
FIG. 9 is an enlarged scale elevation view, partly in section, of detail IX-IX in FIG. 5.

FIGS. 7-8 are a set of relative views to show that the grating sections 22 have tabs 72 on both lateral sides of the grating, and placed at axially-spaced intervals (this is not shown). The drainage channel 24 has sunken seat portions 74 for setting the grating sections on top of such seat portions. The tabs 72 are, originally too wide to set within the riser portions 76 for the seat portions 74. FIG. 7 shows that excess tab portion 72' can be ground to size in FIG. 8 such that the grating section 22 rests solidly between the riser portions 76 as shown in FIG. 9.

That way, this prevents lateral dislocation of the grating portions on their seat portions 74 regardless if in the case of foot traffic or vehicle traffic.

Figure 10:
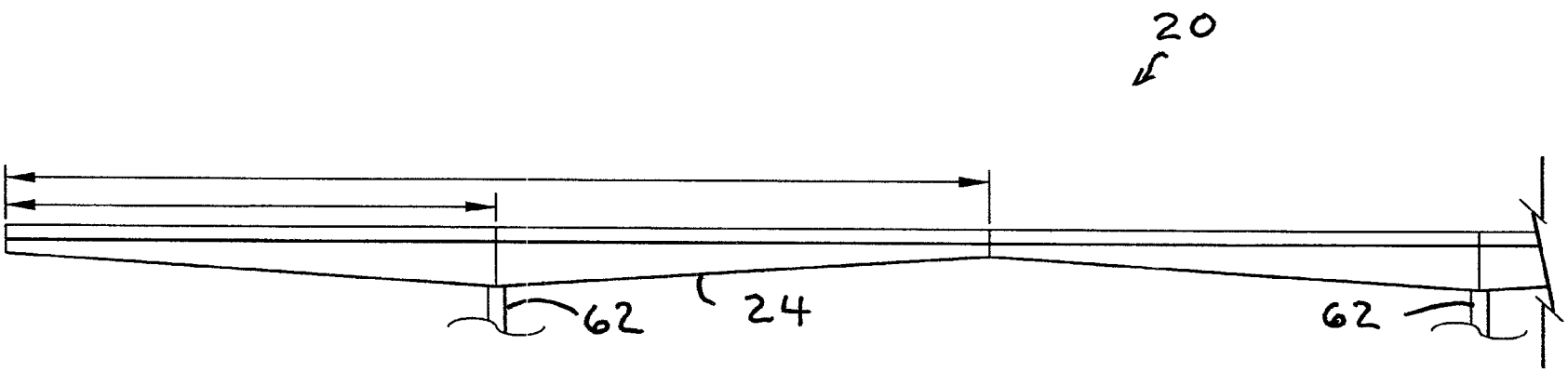
FIG. 10 is a diagrammatic side elevation comparable to FIG. 6 except on a greatly reduced scale and showing the drainage channel installation in accordance with the invention can be extended for an indefinitely long run in the axial direction.

FIG. 10 is a diagrammatic side elevation comparable to FIG. 6 except on a greatly reduced scale and showing the drainage channel installation in accordance with the invention can be extended for an indefinitely long run in the axial direction.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A drainage installation (20) for a warehouse and/or factory floor (44) which has a surface level (26), comprising:

a drainage channel (24) recessed into the floor, said drainage channel (24) having an axially-elongated solid U-shaped channel portion which is flanked by solid horizontal shoulders (30) which then transition into vertically-depending skirt portions (32) which define a cavity underneath the horizontal shoulders (30) between the skirt portions (32) and U-shaped channel portion;

wherein the skirt portions (32) are formed with a series of apertures (36) which either allow the injection of wet cement underneath the shoulder portions (30) of the drainage channel (24), or alternately the venting of the wet cement when the cavity under the shoulder portions (30) are over-filled; and further comprising a plurality of inverted conjoined double-T shaped feet (34) disposed at spaced intervals along the axial length of the drainage channel (24) and buried below the surface level (26) of the floor.

2. The drainage installation (20) of claim 1, further comprising:

a plurality sections of flat grating (22) seated inside the drainage channel (24), and which sections of flat grating (22) are arranged to be more or less planar with the surface level (26).

3. The drainage installation (20) of claim 1, further comprising:

a nozzle (42) for injecting wet cement in through at least one of the apertures (36) of skirt portion (32).

4. The drainage installation (20) of claim 1, further comprising:

a plurality of nozzles (42) for injecting wet cement in a plurality of the apertures (36) of skirt portion (32).

5. A drainage installation (20) for a pre-existing concrete warehouse and/or factory floor (44,46) which has a surface level (26), comprising:

oversize trench (38) through the pre-existing concrete floor (44,46);

a shallow backfill (48) in the oversized trench (38) of aggregate, concrete, mortar or packed fill;

said shallow backfill (48) being provided with a plurality of anchor holes;

a plurality of vertically-extending, pylon-serving threaded studs (54) anchored in the anchor holes;

a drainage channel (24) having an axially-elongated solid U-shaped channel portion which is flanked by horizontal shoulders (30);

wherein the flanking horizontal shoulders (30) of the drainage channel (24) have respective outboard transitions which transition into vertically-depending skirt portions (32); and wherein said skirt portions (32) are formed with a series of apertures (36) which either allow the injection of wet cement underneath the shoulder portions (30) of the drainage channel (24), or alternately the venting of the wet cement when the cavity under the shoulder portions (30) are over-filled;

a plurality of feet (34) disposed at spaced intervals along the axial length of the drainage channel (24) and fastened to the pylon-serving threaded studs (54), whereby during the fastening of the feet (34) to the pylon-serving threaded studs (54) the shoulders (30) of the drainage channel (24) can be leveled with the surface level (26) of the original pre-existing floor (44,46); and an infill (56) of fresh concrete to fill in the trench (38) and even everything up level with the surface level (26) of the original pre-existing floor (36);

wherein said plurality of feet (34) comprise inverted conjoined double-T shaped feet (34).

6. The drainage installation (20) of claim 5, further comprising:

a plurality sections of flat grating (22) seated inside the drainage channel (24), and which sections of flat grating (22) are arranged to be more or less planar with the surface level (26).

7. The drainage installation (20) of claim 5, further comprising:

a nozzle (42) for injecting wet cement in through at least one of the apertures (36) of skirt portion (32).

8. The drainage installation (20) of claim 5, further comprising:

a plurality of nozzles (42) for injecting wet cement in a plurality of the apertures (36) of skirt portion (32).

9. A drainage installation (20) for a warehouse and/or factory floor (44) which has a surface level (26), comprising:

a drainage channel (24) recessed into the floor, said drainage channel (24) having an axially-elongated U-shaped channel portion which is flanked by horizontal shoulders (30) which then transition into vertically-depending skirt portions (32); and a plurality sections of flat grating (22) seated inside the drainage channel (24), and which sections of flat grating (22) are arranged to be more or less planar with the surface level (26);

wherein the grating sections (22) comprise a pair of axial side rails (71) and a series of spaced slats (70) emerging out of the axial side rails (71);

wherein said drainage channel (24) has flanking sunken seat portions (74) transition at outboard transitions into respective riser portions (76), whereby said for grating sections (22) seat on top of such seat portions (74) and within the riser portions (76);

wherein the pair of axial side rails (71) of the grating sections (22) further comprise a series of spaced tabs (72) configured and proportioned to abut and lodge against both spaced riser portions (76) of the drainage channel (24); and wherein the spaced tabs (72) of the axial side rails (71) are originally provided over-sized with respect to landing in between the opposite riser portions (76) of the drainage channel (24), whereby installer personnel grind, file or otherwise remove excess portions (72') of the tabs (72) for a snug fit between the opposite riser portions (76).

10. The drainage installation (20) of claim 9, wherein:

said slats (70) are slanted so that high pressure jets of water during periodic washdown operation do not bounce back out the drainage channel (24), but are deflected in the direction of a drain downpipe (62).

* * * * *